US009057251B2

(12) United States Patent
Broussard et al.

(10) Patent No.: US 9,057,251 B2
(45) Date of Patent: Jun. 16, 2015

(54) GRAVEL PACK INNER STRING HYDRAULIC LOCATING DEVICE

(75) Inventors: John P. Broussard, Kingwood, TX (US); Ronald van Petegem, Montgomery, TX (US); Christopher Hall, Cypress, TX (US); Patrick J. Zimmerman, Houston, TX (US); Brian Ritchey, Hockley, TX (US); Rockni Van Clief, Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 716 days.

(21) Appl. No.: 13/345,544

(22) Filed: Jan. 6, 2012

(65) Prior Publication Data

US 2012/0103603 A1 May 3, 2012

Related U.S. Application Data

(63) Continuation-in-part of application No. 12/913,981, filed on Oct. 28, 2010, now Pat. No. 8,770,290.

(51) Int. Cl.
*E21B 17/07* (2006.01)
*E21B 43/04* (2006.01)
(Continued)

(52) U.S. Cl.
CPC ..... *E21B 43/04* (2013.01); *E21B 17/07* (2013.01); *E21B 23/00* (2013.01); *E21B 47/09* (2013.01)

(58) Field of Classification Search
CPC ..... E21B 43/045; E21B 43/04; E21B 47/09; E21B 2034/007; E21B 17/07; E21B 23/00
USPC ..... 166/255.1, 51, 75.15, 278, 381, 373
See application file for complete search history.

(56) References Cited

U.S. PATENT DOCUMENTS 3,134,439 A 5/1964 Shields
4,105,069 A 8/1978 Baker
(Continued)

FOREIGN PATENT DOCUMENTS

GB 2387401 A 10/2003
RU 2374431 C2 8/2008
(Continued)

OTHER PUBLICATIONS

First Office Action in counterpart Russian Appl. No. 2011143515, dated Nov. 26, 2012.
(Continued)

*Primary Examiner* — Daniel P Stephenson
(74) *Attorney, Agent, or Firm* — Wong, Cabello, Lutsch, Rutherford & Brucculeri, LLP

(57) ABSTRACT

A downhole assembly, such as a toe-to-heel gravel pack assembly, has a body with a body passage, outlet ports for slurry, and screens for fluid returns. An inner string deploys in the body to perform the toe-to-heel gravel packing. A telescoping adjustment device allows the inner string to space out properly when deployed to the toe of the assembly. Sealing surfaces of a locating device in the body separate a sealable space and seal against seals on the inner string movably disposed therein. Fluid pumped in the string produces a pressure buildup when the string's port communicates with the sealable space. The pressure buildup indicates that the tool is positioned at a first location in the assembly, and other positions for placement of the tool can then be calculated therefrom.

33 Claims, 4 Drawing Sheets

(51) Int. Cl.

| | |
|---|---|
| ***E21B 23/00*** | (2006.01) |
| ***E21B 47/09*** | (2012.01) |

(56) References Cited

U.S. PATENT DOCUMENTS

| | | | | |
|---|---|---|---|---|
| 4,440,218 | A | 4/1984 | Farley | |
| 4,474,239 | A | 10/1984 | Colomb et al. | |
| 5,269,375 | A | 12/1993 | Schroeder, Jr. | |
| 5,934,376 | A | 8/1999 | Nguyen et al. | |
| 6,003,600 | A | 12/1999 | Nguyen et al. | |
| 6,176,307 | B1 | 1/2001 | Danos et al. | |
| 6,230,801 | B1 * | 5/2001 | Hill et al. | 166/278 |
| 6,253,851 | B1 | 7/2001 | Schroeder, Jr. et al. | |
| 6,371,210 | B1 | 4/2002 | Bode et al. | |
| 6,446,722 | B2 | 9/2002 | Nguyen et al. | |
| 6,588,507 | B2 | 7/2003 | Dusterhoft et al. | |
| 6,601,646 | B2 | 8/2003 | Streich et al. | |
| 6,675,891 | B2 | 1/2004 | Hailey, Jr. et al. | |
| 6,749,023 | B2 | 6/2004 | Nguyen et al. | |
| 6,857,476 | B2 | 2/2005 | Richards | |
| 6,983,795 | B2 | 1/2006 | Zuklic et al. | |
| 7,017,664 | B2 | 3/2006 | Walker et al. | |
| 7,284,606 | B2 * | 10/2007 | Coronado | 166/255.1 |
| 7,331,388 | B2 | 2/2008 | Vilela et al. | |
| 7,367,395 | B2 | 5/2008 | Vidrine et al. | |
| 7,373,979 | B2 * | 5/2008 | Coronado et al. | 166/278 |
| 7,472,750 | B2 | 1/2009 | Walker et al. | |
| 7,543,641 | B2 * | 6/2009 | Contant | 166/278 |
| 8,528,641 | B2 * | 9/2013 | Clem et al. | 166/278 |
| 8,770,290 | B2 * | 7/2014 | van Petegem et al. | 166/278 |
| 2003/0000702 | A1 | 1/2003 | Streich | |
| 2003/0037925 | A1 | 2/2003 | Walker et al. | |
| 2004/0134656 | A1 | 7/2004 | Richards | |
| 2004/0211559 | A1 | 10/2004 | Nguyen et al. | |
| 2005/0103495 | A1 * | 5/2005 | Corbett | 166/278 |
| 2005/0139355 | A1 | 6/2005 | Corodado | |
| 2006/0060352 | A1 * | 3/2006 | Vidrine et al. | 166/276 |
| 2006/0225878 | A1 | 10/2006 | Coronado | |
| 2007/0187095 | A1 | 8/2007 | Walker et al. | |
| 2007/0227731 | A1 | 10/2007 | Contant | |
| 2008/0099194 | A1 | 5/2008 | Clem | |
| 2009/0095471 | A1 | 4/2009 | Guignard et al. | |
| 2009/0133875 | A1 | 5/2009 | Tibbles et al. | |
| 2010/0096130 | A1 | 4/2010 | Parlar et al. | |
| 2010/0263864 | A1 | 10/2010 | Chay et al. | |
| 2011/0048705 | A1 | 3/2011 | Clem | |
| 2012/0103603 | A1 * | 5/2012 | Broussard et al. | 166/255.1 |
| 2013/0000899 | A1 * | 1/2013 | Broussard et al. | 166/278 |

FOREIGN PATENT DOCUMENTS

| | | | |
|---|---|---|---|
| SU | 1191563 | A | 11/1985 |
| WO | 2005049954 | A2 | 6/2005 |
| WO | 2007126496 | | 11/2007 |

OTHER PUBLICATIONS

Search Report and Written Opinion in counterpart PCT Appl. PCT/US2013/020249, dated Jan. 22, 2014.

Decision on Grant in counterpart Russian Appl. No. 2011143515, dated Mar. 7, 2013.

First Office Action received in counterpart Canadian Appl. No. 2,755,623, dated Jun. 14, 2013.

First Office Action received in counterpart Australian Appl. No. 2011236063, dated May 21, 2013.

First Office Action received in counterpart U.S. Appl. No. 12/913,981, dated May 6, 2013.

Response to First Office Action received in counterpart U.S. Appl. No. 12/913,981, dated May 6, 2013.

Extended Search Report received in counterpart European Appl. No. 12184724.8, dated Jan. 9, 2013.

Schlumberger, "Alternate Path Screens," obtained from www.slb.com/oilfield, dated Jan. 2004, 4 pages.

Schlumberger, "FloRite—Inflow control device," obtained from www.slb.com/transcend, (c) 2009, 2 pages.

Halliburton, "Sand Control: Horizon Low Density, Lightweight Gravel," obtained from www.halliburton.com, (c) 2006, 2 pages.

Edment, Brian, et al., "Improvements in Horizontal Gravel Packing," Oilfield Review, Spring 2005, pp. 50-60.

Synopsis of SPE 38640 by Jones, L.G., et al., "Shunts Help Gravel Pack Horizontal Wellbores with Leakoff Problems," Journal of Petroleum Technology, Mar. 1998, pp. 68-69.

Coronado, Martin, et al., "Completing extended-reach, open-hole, horizontal well," obtained from http://www.offshore-mag.com/index/article-tools-template, generated on May 12, 2010, 5 pages.

Schlumberger, "ResFlow Inflow Control Devices and MudSolv Filtercake Removal Equalize Inflow and Restart Wells," obtained from www.slb.com/sandcontrol, (c) 2010, 2 pages.

Jensen, Rene, et al., "World's First Reverse-Port Uphill Openhole Gravel Pack with Swellable Packers," SPE 122765, 15 pages.

Weatherford, "Model 4P Retrievable Seal-Bore Packer Gravel-Pack System," obtained from www.weatherford.com, (c) 2005-2009, 2 pages.

Brannon, D.H., et al., "A Single-Trip, Dual-Zone Gravel Pack System Successfully Gravel Packs Green Canyon Area Wells, Gulf of Mexico," SPE 21670, (c) 1991, 7 pages.

Weatherford, "Hydraulic-Release Hookup Nipple Circulating Gravel-Pack System," obtained from www.weatherford.com, (c) 2005, 2 pages.

Weatherford, "Conventional Well Screens," obtained from www.weatherford.com, (c) 2004-2009, 16 pages.

Weatherford, "Model WFX Setting Tools," obtained from www.weatherford.com, (c) 2007-2008, 2 pages.

Weatherford, "Model WFX Crossover Tool," obtained from www.weatherford.com, (c) 2007-2008, 2 pages.

Weatherford, "Real Results: Completion Package Eliminates Sand Production, Enhances Reliability in Siberian Oil-Production Well," obtained from www.weatherford.com, (c) 2009, 1 page.

* cited by examiner 110
112
114
116
118
120
125
130
135
160
161
162
163
164
165

GRAVEL PACK INNER STRING HYDRAULIC LOCATING DEVICE

CROSS-REFERENCE TO RELATED APPLICATIONS

This is a continuation-in-part of U.S. application Ser. No. 12/913,981, filed 28 Oct. 2010, which is incorporated herein by reference in its entirety and to which priority is claimed.

This application is filed concurrently with U.S. patent application Ser. No. 13/345,418 and entitled "One Trip Toe-to-Heel Gravel Pack and Liner Cementing Assembly," U.S. patent application Ser. No. 13/345,476 and entitled "Gravel Pack Inner String Adjustment Device," and U.S. patent application Ser. No. 13/345,500 and entitled "Gravel Pack Bypass Assembly," which are also incorporated herein by reference in their entireties.

BACKGROUND

Some oil and gas wells are completed in unconsolidated formations that contain loose fines and sand. When fluids are produced from these wells, the loose fines and sand can migrate with the produced fluids and can damage equipment, such as electric submersible pumps (ESP) and other systems. For this reason, completions can require screens for sand control.

Horizontal wells that require sand control are typically open hole completions. In the past, stand-alone sand screens have been used predominately in these horizontal open holes. However, operators have also been using gravel packing in these horizontal open holes to deal with sand control issues. The gravel is a specially sized particulate material, such as graded sand or proppant, which is packed around the sand screen in the annulus of the borehole. When applied, the gravel acts as a filter to keep any fines and sand of the formation from migrating with produced fluids.

In a gravel pack assembly for a horizontal open hole, proper linear spacing of an inner service tool relative to outer components of the assembly can be particularly important. Operators typically run fixed pipe lengths down the assembly and rely on pipe tallies and available pipe lengths to determine the correct space out for the service tool in the assembly. Unfortunately, the lengths of any screens and the service tool in the horizontal open hole can be considerable, and relying on pipe tallies to achieve correct spacing may prove difficult.

Additionally, the service tool for a gravel pack assembly is typically moved to perform various functions during gravel pack operations. Due to well depth, deviation, tubing stretch, friction, and the type of gravel pack completion to be run, determining the position of the service tool downhole in the assembly can be very difficult. This is especially true in long horizontal gravel pack completions. In the end, pumping of sand slurry when the tool is in an incorrect position in the assembly can cause the service tool to stick and can have catastrophic consequences.

Typically, mechanical indicating collets have been used in the prior art to locate the service tool in the assembly. Additionally, "smart" collets have been used, which reciprocate between a relaxed position and a propped position for positive identification of the service tool's location. Unfortunately, mechanical indication may not always work due to high drag forces and other issues involved in moving the service tool in the downhole assembly.

The subject matter of the present disclosure is directed to overcoming, or at least reducing the effects of, one or more of the problems set forth above.

SUMMARY

As noted above, proper linear spacing of an inner service tool relative to outer components of a downhole assembly can be particularly important. To deal with this issue, an adjustment device is used to adjust a length of an inner string deployed in a downhole assembly, such as a toe-to-heel gravel pack assembly. The device has first and second (tubular) members telescopically coupled together. The first member is coupled to one portion of the inner string, while the second member is coupled to another portion of the inner string. A ratchet disposed on the first member can engage a catch on the second member to fix the length of the adjustment device. The ratchet can include a dog having a plurality of chamfered teeth. The catch, which is movable relative to the ratchet, can include a plurality of grooves defined around the outside of the second member to engage the teeth of the ratchet dog.

The inner string and device are deployed in the downhole assembly to determine proper space out of the inner string for subsequent operation, such as gravel packing. When deployed, the first and second members of the device are in an extended condition. When the inner string eventually bottoms out in the assembly, the ratchet allows the second member to move in one direction relative to the first member so the device can collapse and shorten the length of the inner string. A key between the two members can ride in a slot, which allows the two members to slide relative to one another but not rotate.

When the inner string is then pulled up from the downhole assembly, the ratchet engages the catch (i.e., the teeth on the dog engages in the grooves) to prevent the second member from moving in an opposite direction relative to the first member. In this way, the device does not extend again as the inner string is pulled uphole so the device is maintained in one fixed length.

When the device is brought to the surface, operators can permanently maintain the adjustment device in its fixed length determined downhole by installing a locking element between first and second telescoping members. For example, operators can replace the ratchet dogs with chamfered teeth with locking dogs having unchamfered teeth. Engaged in the grooves of the catch, the locking dog will prevent movement of the second member in either direction inside the first member.

As noted previously, knowing the location of a downhole inner string in a downhole assembly can facilitate operations. To deal with this issue, a downhole assembly, such as a gravel pack assembly, has a body defining a body passage therethrough. First sealing surfaces or seats disposed in the body passage separate a sealable space in the body passage. For example, these seats can be polished surfaces in the body passage having a smaller diameter than the rest of the passage.

An inner string, such as an inner string of a gravel pack assembly, is movably disposed in the body passage and defines a bore for communicating fluid from a surface pump to an outlet port on the inner string. A valve in the bore can divert the pumped fluid out the outlet port.

First seals disposed on the inner string selectively seal with the first seats when the inner string is moved in the body. When this occurs, the outlet port communicates the pumped fluid into the sealable space of the body, which produces a measurable pressure buildup. Using the pressure buildup as an indication, a first position of the inner string can then be correlated to the known location of the sealable space in the downhole assembly. A second position for the inner string in the body can then be calculated based on a known distance in the downhole assembly from the first location to a second location of another feature, such as a port in the assembly. Being able to determine positions for the inner string allows operators to more properly position the inner string to desired locations in the downhole assembly during gravel pack or other operations.

The foregoing summary is not intended to summarize each potential embodiment or every aspect of the present disclosure.

DETAILED DESCRIPTION

A. Downhole Assembly

Figure 1:
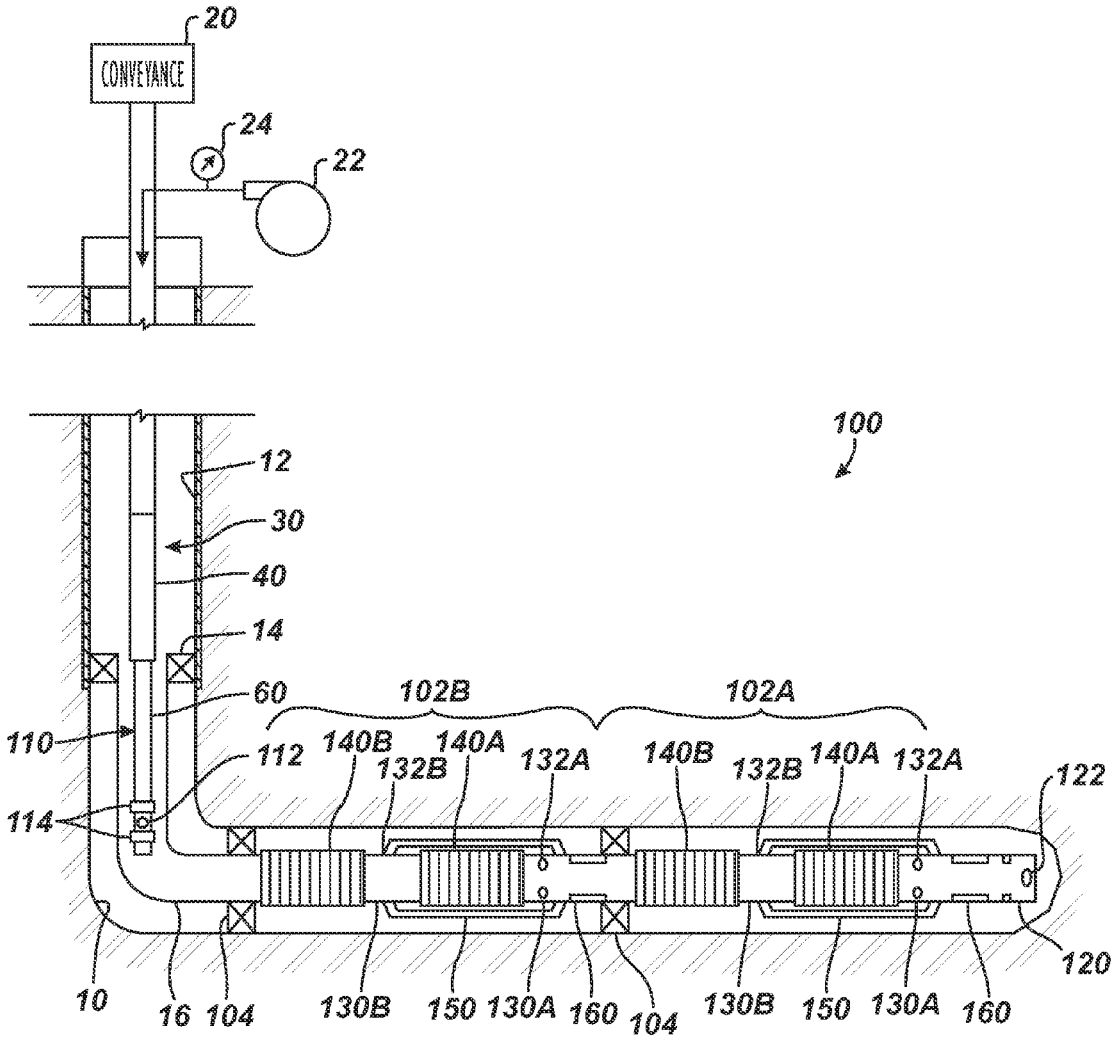
FIG. 1 shows a gravel pack assembly having an adjustment device and a hydraulic locating device for an inner string.

FIG. 1 shows a downhole assembly 100 having an adjustment device 30 and a locating device 160 according to the present disclosure. As shown, the downhole assembly 100 is a gravel pack assembly, although other type of assemblies used downhole can benefit from the disclosed devices 30 and 160. As one example, a cementing assembly for cementing a liner in an open borehole may benefit from the disclosed devices 30 and 160. With the benefit of the present disclosure, other suitable downhole assemblies for one or both of the devices 30 and 160 will be apparent to one of ordinary skill in the art.

The gravel pack assembly 100 has multiple gravel pack sections 102A-B, but the assembly 100 can generally have one or more sections. With multiple sections 102A-B, however, the assembly 100 segments compartmentalized reservoir zones so that multiple gravel pack and frac pack operations can be performed in the borehole 10. Isolating elements 104, such as packers, can dispose between these gravel pack sections 102A-B to isolate them from one another.

In any event, the gravel pack assembly 100 can be similar to the gravel pack assemblies disclosed in incorporated U.S. application Ser. No. 12/913,981. As such, the gravel pack assembly 100 is a toe-to-heel gravel pack system that allows operators to pack the borehole 10 from the toe to heel in each section 102A-B. In the depicted configuration, each gravel pack section 102A-B has two screens 140A-B, alternate path devices or shunts 150, and ported housings 130A-B with ports 132A-B, although any of the other disclosed variations can be used.

Briefly, gravel pack operations with the assembly 100 involve initially deploying an inner string 110 into the first gravel pack section 102A. A conveyance 20 manipulates the inner string 110 and can use any of the conveyance methods known in the art. During operations, a pumping system 22 can pump fluid and/or slurry for a gravel or frac pack operation down the inner string 110 as needed, and a pressure sensor 24 can detect a buildup of pressure caused by the pumped fluid. Many of these features are conventional components and are not described in detail here.

Once the inner string 110 is deployed in the assembly 100, the uphole packer 14 on a liner hanger and other packers 104 along the assembly 100 remain unset. Operators pump washdown fluid through the inner string 110, and the circulated fluid leaves the string's outlet ports 112 and passes through a float shoe 122 of a shoe track 120 at the end of the first section 102A. In washing down the borehole 10, the circulated fluid passes through the annulus and uphole so the fluid can enter the casing 12 and return to the surface.

After washdown and setting of the packers 14 and 104, the assembly 100 can commence with gravel pack operations. The string's outlet ports 112 with its seals 114 isolate in fluid communication with the lower flow ports 132A in the first housing 130A of the first section 102A. Positioning the string's ports 112 with the flow ports 132A requires operators to calculate distances and determine the string's position in the assembly 100 relative to the ports' locations. To help with these procedures, the assembly 100 uses a hydraulic locating device 160 as discussed in detail below. As shown, the device 160 is preferably located between the shoe track 120 and the ported housing 130A.

With the string's ports 112 communicating with the first ports 132A, slurry can then be pumped down the inner string 110 to gravel and frac pack the surrounding zone of the borehole 10. As the slurry enters the surrounding borehole annulus, gravel packing of the first section 102A occurs in a toe-to-heel arrangement as discussed in detail in incorporated U.S. application Ser. No. 12/913,981.

Once sandout occurs at this port 132A, the inner string 110 can again be moved so that the outlet ports 112 isolate to upper flow ports 1328 connected to the shunts 150 in this first section 102A. Slurry pumped down the inner string 110 can then fill the borehole annulus around the lower end of the shoe track 120, which can be done to further pack the borehole 10 or to dispose of excess slurry from the string 110.

Operations can then proceed with similar steps being repeated up the borehole 10 for each of the subsequent gravel pack sections (e.g., 102B) separated by the intervening packers 104. Again, additional details and steps in the operation of the toe-to-heel gravel pack system 100 of FIG. 1 are provided in incorporated U.S. application Ser. No. 12/913,981 so they are not repeated here in detail.

B. Adjustment Device

As noted previously, proper linear spacing of a service tool relative to outer assembly components can be important, especially in a horizontal open hole. Rather than running fixed pipe lengths and relying on a pipe tally and available pipe lengths to achieve correct space out for the inner string 110, operators make up the adjustment device 30 on the inner string 110 above the outlet ports 112 and seals 114. The device 30 allows operators to achieve proper spacing, which is even more critical in the toe-to-heel assembly 100 of the present disclosure.

Notably, the inner string 110 in this toe-to-heel assembly 100 first locates at the bottom of the shoe track 120 to communicate washdown fluid out the float shoe 122 as described above. The gravel pack operation then proceeds with the inner string 110 being moved to a number of flow ports 132 along the assembly 100. If the inner string 110 is not run or spaced out properly, then operations will not proceed effecting, and the assembly 100 may become damaged.

To help space out the inner string 110, the adjustment device 30 has an upper member 40 with a distal member 60 telescopically disposed therein. Thus, the distal member 60 is linearly expandable and collapsible relative to the upper member 40. Before actually commencing gravel pack operations, operators make up the device 30 in its extended condition on the inner string 110 and then run the inner string 110 and the expanded adjustment device 30 downhole. Eventually, the inner string 110 tags against the bottom of the gravel pack assembly 100, and the adjustment device 30 collapses until the upper member 40 of the adjustment device 30 (or some other portion of the inner string 110) shoulders out. At this point, the inner string 110 has obtained its proper space out length in the assembly 100.

At the surface, operators mark the exposed pipe to indicate the extent of pipe used during run-in, and operators then raise the adjustment device 30 and inner string 110 back out of the well. As the adjustment device 30 is pulled uphole, the device 30 at least temporarily locks in position so the adjustment device 30 maintains a fixed length. At the surface, operators then fix the current length of the adjustment device 30 to prevent further adjustment. Finally, operators run the inner string 110 and fixed device 30 back downhole into the assembly 100, and the determined space out will put the bottom of the inner string 110 in the desired location in the first gravel pack section 102A, as needed.

Figure 2:
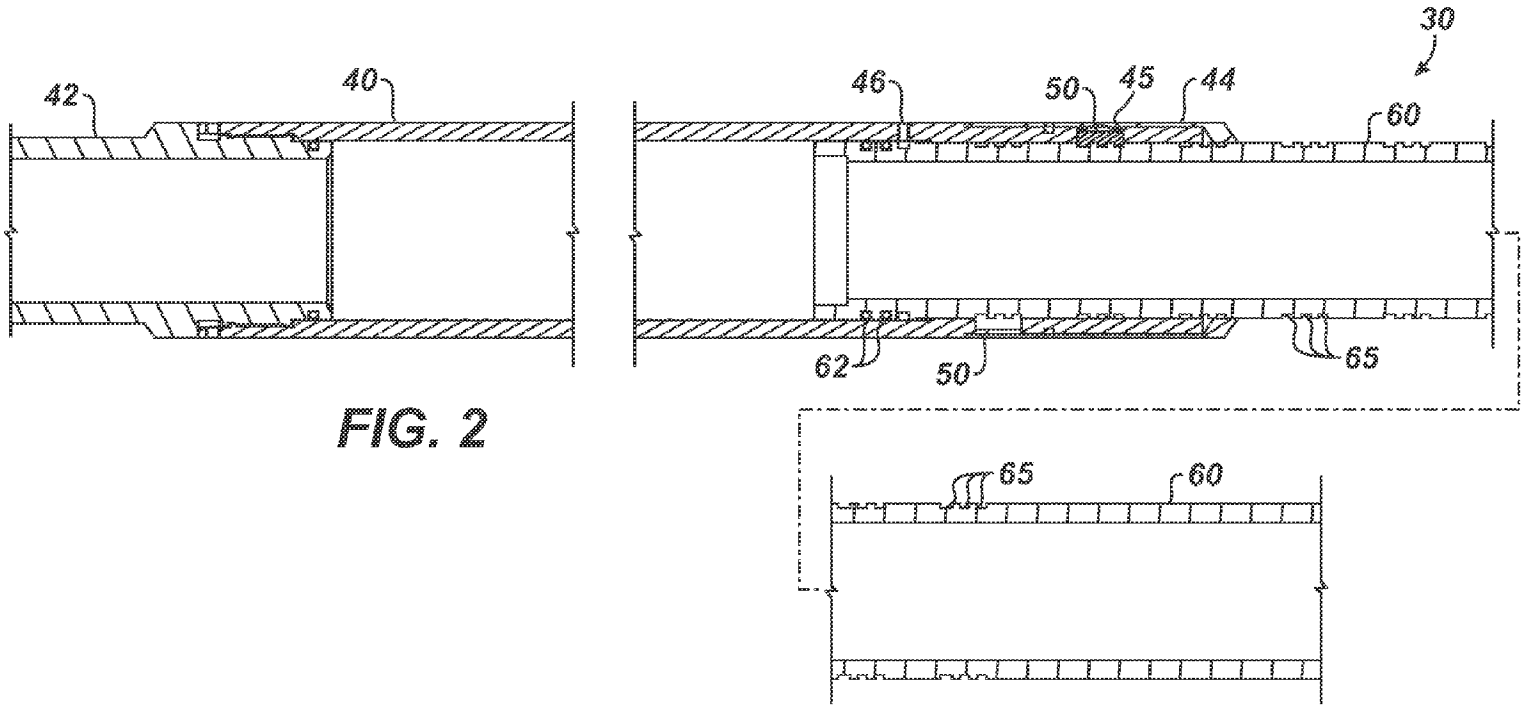
FIG. 2 shows a cross-section of an adjustment device according to the present disclosure.

FIG. 2 shows the adjustment device 30 in more detail. As noted previously, the device 30 includes an upper (tubular) member 40 and a distal (tubular) member 60 telescopically disposed therein. Although the device 30 is shown with two telescoping members 40 and 60, more members could be used.

At its uphole end, the upper member 40 has a coupling 42 that couples to uphole components (not shown), such as an uphole portion of the inner string (110). The distal member 60 extends from the upper member's downhole end, and the two members 40 and 60 may be initially held in an extended condition by shear pins 46 or the like. Ratchet dogs 50 are disposed in slots 45 around the outside of the upper member 40, and a retaining sleeve 44 disposed on the upper member 40 helps hold the ratchet dogs 50 in place. Seals 62 on the distal member 60 engage inside the upper member 40 to inhibit fluid flow between the members 40 and 60.

The outside of the distal member 60 has catches or grooves 65 spaced apart from one another along most of the member's length. The actual length of the members 40 and 60 can be much greater than depicted in FIG. 2 so that the distal member 60 can expand and collapse a considerable distance as need for an implementation.

In FIG. 2, the device 30 is shown extended as when it is initially run downhole. When fully extended, the ratchet dogs 50 engage in the topmost catch grooves 65 on the distal member 60. After the device 30 locates on bottom in the assembly 100, the members 40 and 60 collapses, and the ratchet dogs 50 ratchet up the catch grooves 65 on the distal member 60.

Figure 3:
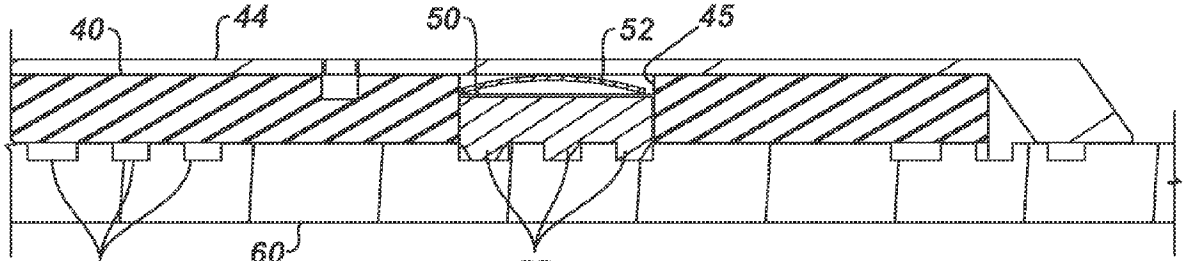
FIG. 3 shows a detail of a ratchet dog and grooves for the disclosed adjustment device.

FIG. 3 shows a detail of the ratchet dogs 50 engaging in catch grooves 65 on the distal member 60. The ratchet dogs 50 have a number of teeth 55 with chamfered leading edges. As the distal member 60 moves into the upper member 40, the chamfered teeth 55 let the catch grooves 65 pass thereby.

Springs 52 disposed behind the ratchet dogs 50 bias them toward the surface of the distal member 60 so the teeth 55 can engage in the catch grooves 65. The springs 52 can be leaf springs or other types of biasing elements. Preferably, the catch grooves 65 are arranged in sets to engage the multiple teeth 55 on the ratchet dogs 50, but it will be appreciated that a number of ratcheting mechanisms can be used, including those conventionally used in downhole tools for packers or sliding sleeves.

As the inner string 110 is disposed in the assembly 100 and engages bottom, the members 40 and 60 collapse together until the upper member 40 (or some other part of the inner string 110) shoulders out in the assembly 100. Shouldering can be achieved in a number of ways. For example, the assembly 100 can have a restricted passage that allows the distal member 60 to pass therethrough when bottoming out in the assembly 100, but the restricted passage engages the upper member 40 when moved against it.

Once the device 30 is collapsed and shoulders out, operators pull up the inner string 110 to the surface. Operators remove the retaining sleeve 44 and replace the ratchet dogs 50 with locking dogs (not shown) in the slots 45. These locking dogs (not shown) can be similar to the ratchet dogs 50, but they lack ratcheting chamfers so the locking dogs will not ratchet in the distal member's catch grooves 65. Operators then make up the sleeve 44 so the locking dogs are held and distal member 40 is permanently locked in position. At this point, operators can redeploy the inner string 110 with the device 30 in its fixed length downhole to proceed with gravel pack operations.

Figure 4A:
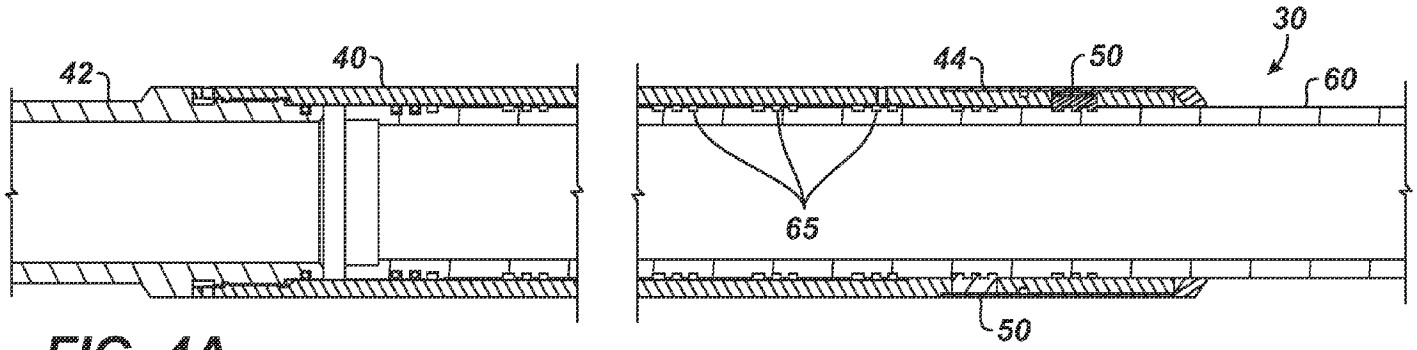
FIGS. 4A-4B shows the adjustment device in a fully collapsed state along different cross-sectional planes.
Figure 4B:
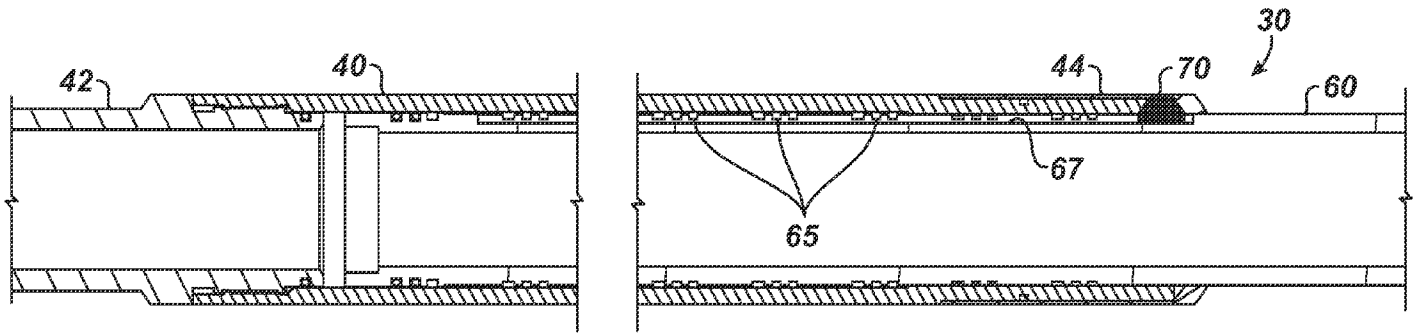

FIGS. 4A-4B show different cross-sections of the adjustment device 30 in a fully collapsed position. FIG. 4A shows the ratchet dogs 50 disposed in the upper member 40 for engaging the outer catch grooves 65 in the distal member 60. In general, one or more such dogs 50 can be used, but the dogs 50 are preferably arranged consistently about the circumference of the members 40 and 60, although they need not be at the same longitudinal location.

FIG. 4B shows a key 70 disposed in the upper member 40 and held by the sleeve 44. The key 70 rides within a longitudinal groove 67 along a length of the distal member 60. Thus, the two members 40 and 60 can slide relative to one another, but the key 70 prevents rotation of the members 40 and 60 relative to one another. Although one key 70 is shown, more than one key 70 may be used.

C. Locating Device

As can be seen in the toe-to-heel gravel pack assembly 100 of FIG. 1, the inner string 110 runs to the very bottom of the assembly 100 to the shoe track 120 for washdown during gravel pack operations. Then, the inner string 110 is manipulated in the assembly 100 to a number of ports 132A-132B and other positions to perform the gravel pack operations in the various sections 102A-B. As will be appreciated, knowing the location (distance) of various features (ports, etc.) relative to the position of the inner string 110 in the assembly 100 can help operators move and position the inner string 110 properly and effectively in the assembly 100 during operations.

To that end, the gravel pack assembly 100 includes one or more locating device 160 disposed thereon for locating the inner string 110 at different positions in the assembly 100. As shown in FIG. 1, one of the locating devices 160 can be disposed near the shoe track 120 between the float shoe 122 and the first ports 132A on the ported housing 130A of the first section 102A. Having the device 160 in this location allows operators to correlate the inner string's position to at least one location in the assembly 100, and preferably the furthest location. As will be appreciated, the length of the assembly 100, the length of the inner string 110 to reach the assembly's end, drag forces, friction, possible deflection, and other factors may make conventional techniques for locating the inner string 110 in the assembly 100 difficult. Therefore, having the locating device 160 in this distal location of the assembly 100 can be beneficial for determining other positions for the inner string 110 in the assembly 100.

Knowing this one location of the device 160 at the distal extent and knowing the details and dimensions of the assembly 100 disposed downhole, operators can then calculate distances to other locations (i.e., ports 132A-B) on the assembly 100 so other positions for the placement of the inner string 110 can be determined. If desired, the locating device 160 could be located elsewhere on the assembly 100.

Moreover, more than one locating device 160 can be used on the assembly 100 so several locations can be determined along the assembly 100 during operations. For example, each section 102A-B of the assembly 100 can have a comparable locating device 160 so positions for the inner string 110 can be determined at multiple locations when performing operations. In the end, this can help operators find the various ports 132A-B individually in the sections 102A-B.

Figures 5A, 5B, 5C:
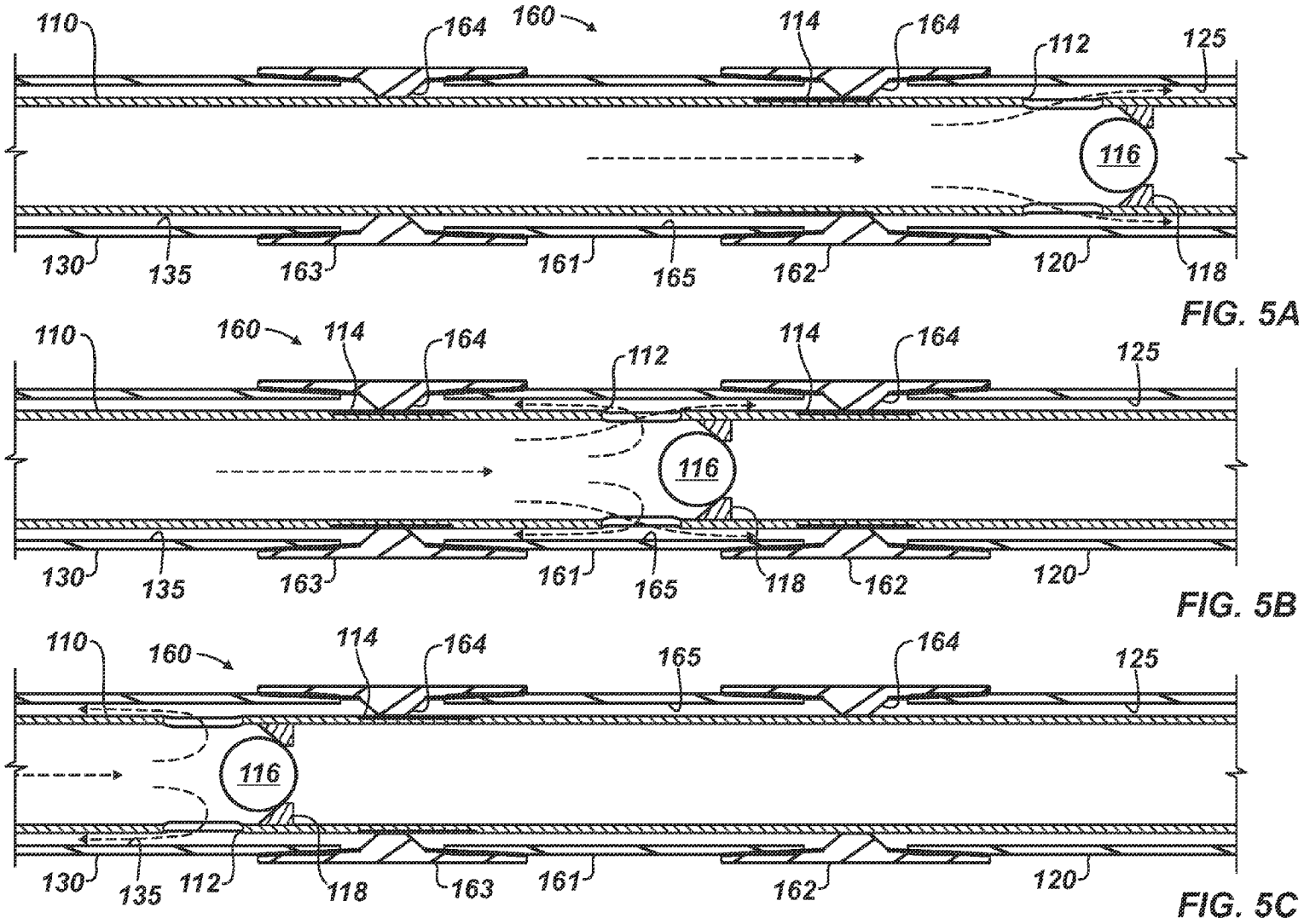
FIG. 5A shows portion of the assembly and locating device in an initial stage of engagement.
FIG. 5B shows portion of the assembly and locating device in a sealed stage of engagement.
FIG. 5C shows portion of the assembly and locating device in a subsequent stage of engagement.

Rather than using mechanical techniques for location, which can be unreliable, the locating device 160 uses hydraulic techniques for locating the position of the inner string 110 in the assembly 100. Turning to FIGS. 5A-5C, portion of the assembly 100 is shown with the inner string 110 disposed in a locating device 160. Here, the locating device 160 includes a tubular 161 connected by a downhole coupling 162 to the shoe track 120 and connected by an uphole coupling 163 to a ported housing 130. Again, the device 160 could be located elsewhere on the assembly 100, in which case the couplings 162, 163 would couple to other components, such as between uphole and downhole sections 102A-B of the assembly 100.

Figure 6:
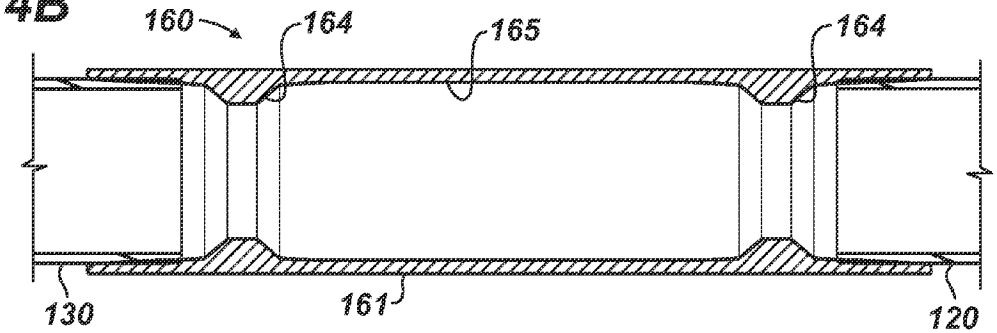
FIG. 6 shows portion of the assembly having another locating device with an integral housing.

Rather than using separate couplings 162, 163 as shown, the device 160 can be an integral component as shown in FIG. 6 having its tubular housing 161 with coupling members formed thereon. Either way, the device 160 of FIGS. 5A-5C and 6 has an inner passage 165 that is in fluid communication with passages 135 and 125 of the housing 130 and shoe track 120. The inner passage 165 forms a sealable space with internal sealing surfaces or seats 164 disposed at both ends. These seats 164 can be internal polished surfaces with a reduced diameter from the other passages 125/135/165.

The inner string 110 has external seals 114 disposed one each side of outlet ports 112. The seals 114 are adapted to engage the inner polished seats 164 of the couplings 161, 163 as discussed below. (A reverse arrangement may also be used in which the couplings 161, 163 have internal seals for engaging polished seats on the inner string 110.) As shown here, the inner string 110 also includes a valve (i.e., seat 116 and dropped ball 118) that can close off fluid flow down the string 110 and divert the flow out the outlet ports 112. Other valve arrangements could also be used, or the distal end of the inner string 110 can be permanently closed off.

As shown in FIG. 5A, as the inner string 110 passes uphole in the assembly 100 from the shoe track 120 (or a lower section 102) to the locating device 160, circulated fluid is pumped slowly down the string 110 and is diverted out the outlet ports 112. (In general, the circulated fluid can be any suitable fluid used during gravel/frac pack operations. Preferably, the circulated fluid is water, brine, or some other type of carrying or washdown fluid. Although less desirable, the circulated fluid could include gravel packing slurry or frac treatment.)

As it is pumped, the circulated fluid can flow downhole in the annulus between the string 110 and assembly 100 (i.e., shoe track 120 and other downhole component). Eventually as shown in FIG. 5A, the upper seal 114 of the string 110 engages the lower seat 164 of the locating device 160.

With further uphole movement of the string 110 as shown in FIG. 5B, the outlet ports 112 reach the inner passage 165 of the device 160, and the seals 114 engage the seats 164. This creates a sealed space of the passage 165 in the device 160 that is isolated from uphole and downhole portions of the assembly's inner passages 135 and 125. The sealing between the seals 114 and the seats 164 may be intended to inhibit flow and may not necessarily create a fluid tight seal.

As the string 110 reaches this sealable space of the passage 165, fluid pumped slowly down the inner string 110 to the string's outlet ports 112 creates a measurable buildup in pressure, which can be detected by the pressure sensor (24) at the surface or elsewhere on the assembly 100. Further movement of the string 110 uphole eventually moves the seals 114 out of the device 160 as shown in FIG. 5C. At this point, the circulated fluid can exit the outlet ports 112 and can pass up the annulus so there is no more measurable pressure buildup.

When the pressure buildup occurs with the string's ports 112 sealed at the locating device 160, operators can identify this buildup and can associate the string's current position with the location of the device 160 on the assembly 100. From this known location and the known dimensions and configuration of the assembly 100 deployed downhole, other position for positioning the inner string 110 can be calculated for other desired locations on the assembly 100. Movement to these other positions can be easily achieved by further moving the inner string 110 the calculated distances to the other locations of the assembly 100.

The locating device 160 works regardless of the amount of pipe and drag in the inner string 110 when manipulated in the assembly 100. Therefore, at any time during operations, this known location of the device 160 can be found by movement of the string 110 and slow pumping until indication is observed so calculations to other locations can be determined.

Movement of the inner string 110 in the assembly 100 of FIGS. 5A-5C has been uphole. The locating device 160, however, can operate equally as well with downhole movement of the string 110 in the device 160. Furthermore, although the locating device 160 has been used on a particular gravel pack assembly 100 in which gravel packing occurs from toe-to-heel, the features of the locating device 160 and inner string 110 can be used on any suitable downhole assembly in which circulated fluid from a port on the string 110 can help locate the string's position in the locating device 160 and further help determine other positions for the string 110 in the downhole assembly. For example, the locating device 160 could be used with a conventional gravel pack assembly and a crossover tool, or the locating device 160 could be used with a cementing assembly and a service tool. Additionally, the locating device 160 can be helpful in locating an inner string in a number of downhole components, such as locating in an extend reach frac pack assembly, a multi-zone frac system, an inflatable packer, and others. Accordingly, the above-description directed to the particular gravel pack assembly 100 is meant to be illustrative of a particular application of the disclosed subject matter.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A method of hydraulically locating an inner string in a downhole assembly, the method comprising:

pumping fluid out an outlet port on the inner string disposed in the downhole assembly;

moving the inner string through an inner passage in the downhole assembly;

at least partially restricting the pumped fluid from the outlet port in a sealable space in the inner passage of the downhole assembly, the sealable space associated with a first location on the downhole assembly;

detecting a pressure buildup of the pumped fluid in response to the at least partial restriction; and correlating, in response to the detected pressure buildup, a first position of the inner string to the first location in the downhole assembly.

2. The method of claim 1, wherein the downhole assembly comprises a gravel pack assembly defining a flow port at a second location.

3. The method of claim 2, wherein the method comprises calculating a second position for placement of the outlet port using a known distance of the flow port on the gravel pack assembly from the first location.

4. The method of claim 3, wherein the sealable space at the first location is disposed between a shoe track and the flow port on the gravel pack assembly.

5. The method of claim 1, wherein pumping fluid out the outlet port comprises pumping fluid in a bore of the inner string and diverting the pumped fluid out the outlet port with a valve disposed in the bore.

6. The method of claim 1, wherein at least partially restricting the pumped fluid from the outlet port in the sealable space in the inner passage of the downhole assembly comprises engaging seals on the inner string against sealing surfaces in the inner passage of the downhole assembly.

7. The method of claim 6, wherein the sealing surfaces comprise polished surfaces having a diameter smaller than the inner passage of the downhole assembly.

8. The method of claim 1, further comprising calculating a second position for placement of the inner string at a second location in the downhole assembly using a known distance in the downhole assembly from the first location to the second location in the downhole assembly.

9. A downhole assembly, comprising:

a body disposed in a borehole and defining a body passage therethrough;

first sealing surfaces disposed in the body passage and separating a sealable space in the body passage, the sealable space associated with a first location on the downhole assembly;

an inner string movably disposed in the body passage on either side of the sealable space and defining an inner bore therethrough, the inner string defining an outlet port communicating with the inner bore and having first seals disposed on the inner string, the first seals selectively sealing with the first sealing surfaces and communicating the inner bore with the sealable space through the outlet port, wherein the outlet port communicates fluid out of the inner bore of the inner string to the body passage of the body as the inner string is moved on either side of the sealable space, and wherein a pressure buildup produced by the outlet port communicating fluid to the sealable space indicates a first position of the inner string corresponding to the first location in the downhole assembly.

10. The assembly of claim 9, wherein the body is a component of a gravel pack assembly.

11. The assembly of claim 9, wherein the body defines a flow port at a second location on the downhole assembly.

12. The assembly of claim 11, wherein a second position for placement of the inner string in the downhole assembly is calculated based on a known distance of the second location from the first location.

13. The assembly of claim 11, wherein the flow port is disposed between a screen and a float shoe, and wherein the first location associated with the sealable space is disposed between the flow port and the float shoe.

14. The assembly of claim 9, wherein the inner string comprises a valve disposed in the inner bore and diverting fluid out the outlet port.

15. The assembly of claim 9, wherein the first sealing surfaces comprises polished surfaces having a diameter smaller than the body passage of the downhole assembly.

16. The assembly of claim 9, wherein the first location indicates at least one second location calculated based on a known distance in the downhole assembly of the at least one second location from the first location.

17. The assembly of claim 9, further comprising:

second sealing surfaces disposed in the body passage and separating another sealable space in the body passage, the other sealable space associated with a second location on the assembly, wherein another pressure buildup produced by the outlet port communicating fluid to the other sealable space indicates a second position of the inner string corresponding to the second location in the downhole assembly.

18. A downhole apparatus, comprising:

a body disposed in a borehole and defining a body passage therethrough;

an inner string movably disposed in the body passage, the inner string defining an inner bore therethrough and defining an outlet port communicating with the inner bore;

means for communicating fluid from the inner bore of the inner string out the outlet port to the body passage of the body as the inner string is moved on either side of a sealable space in the body passage;

means for at least partially sealing the outlet port with the sealable space in the body passage, the sealable space associated with a first location on the downhole apparatus;

means for building up pressure in response to fluid in the inner bore communicated to the sealable space through the outlet port; and means based on the buildup of pressure for correlating a first position of the inner string with the first location in the downhole apparatus.

19. The apparatus of claim 18, further comprising means for calculating a second position for placement of the inner string in the downhole assembly.

20. The apparatus of claim 18, wherein the body comprises means at a second location for directing slurry to the borehole.

21. The apparatus of claim 20, wherein the body comprises means for screening fluid returns from the borehole into the body passage.

22. A downhole assembly, comprising:

a body disposed in a borehole and defining a body passage therethrough, the body defining a flow port at a second location on the downhole assembly between a screen and a float shoe;

first sealing surfaces disposed in the body passage and separating a sealable space in the body passage, the sealable space associated with a first location on the downhole assembly being disposed between the flow port and the float shoe;

an inner string movably disposed in the body passage and defining an inner bore therethrough, the inner string defining an outlet port communicating with the inner bore and having first seals disposed on the inner string, the first seals selectively sealing with the first sealing surfaces and communicating the inner bore with the sealable space through the outlet port, wherein a pressure buildup produced by the outlet port communicating fluid to the sealable space indicates a first position of the inner string corresponding to the first location in the downhole assembly.

23. The assembly of claim 22, wherein the body is a component of a gravel pack assembly.

24. The assembly of claim 23, wherein a second position for placement of the inner string in the downhole assembly is calculated based on a known distance of the second location from the first location.

25. The assembly of claim 22, wherein the inner string comprises a valve disposed in the inner bore and diverting fluid out the outlet port.

26. The assembly of claim 22, wherein the first sealing surfaces comprises polished surfaces having a diameter smaller than the body passage of the downhole assembly.

27. The assembly of claim 22, further comprising:

second sealing surfaces disposed in the body passage and separating another sealable space in the body passage, the other sealable space associated with a third location on the assembly, wherein another pressure buildup produced by the outlet port communicating fluid to the other sealable space indicates another position of the inner string corresponding to the third location in the downhole assembly.

28. A downhole assembly, comprising:

a body disposed in a borehole and defining a body passage therethrough;

first sealing surfaces disposed in the body passage and separating a first sealable space in the body passage, the first sealable space associated with a first location on the downhole assembly;

second sealing surfaces disposed in the body passage and separating a second sealable space in the body passage, the second sealable space associated with a second location on the assembly;

an inner string movably disposed in the body passage and defining an inner bore therethrough, the inner string defining an outlet port communicating with the inner bore and having first seals disposed on the inner string, the first seals selectively sealing with the first and second sealing surfaces and communicating the inner bore with the first and second sealable space through the outlet port, wherein a pressure buildup produced by the outlet port communicating fluid to the first sealable space indicates a first position of the inner string corresponding to the first location in the downhole assembly, and wherein another pressure buildup produced by the outlet port communicating fluid to the second sealable space indicates a second position of the inner string corresponding to the second location in the downhole assembly.

29. The assembly of claim 28, wherein the body is a component of a gravel pack assembly.

30. The assembly of claim 28, wherein the body defines a flow port at a third location on the downhole assembly.

31. The assembly of claim 30, wherein a third position for placement of the inner string in the downhole assembly is calculated based on a known distance of the third location from the first location.

32. The assembly of claim 28, wherein the inner string comprises a valve disposed in the inner bore and diverting fluid out the outlet port.

33. The assembly of claim 28, wherein the first sealing surfaces comprise polished surfaces having a diameter smaller than the body passage of the downhole assembly.

* * * * *